US010035373B2

(12) United States Patent
Yoshimoto et al.

(10) Patent No.: US 10,035,373 B2
(45) Date of Patent: Jul. 31, 2018

(54) METHOD FOR AFFIXING DECORATIVE OBJECT AND DECORATIVE OBJECT

(71) Applicant: HONDA MOTOR CO., LTD., Tokyo (JP)

(72) Inventors: Masaru Yoshimoto, Tochigi-ken (JP); Takuji Yamahiro, Utsunomiya (JP); Natsuki Mamiya, Utsunomiya (JP)

(73) Assignee: HONDA MOTOR CO., LTD., Tokyo (JP)

( * ) Notice: Subject to any disclaimer, the term of this patent is extended or adjusted under 35 U.S.C. 154(b) by 53 days.

(21) Appl. No.: 14/903,635

(22) PCT Filed: Mar. 27, 2014

(86) PCT No.: PCT/JP2014/058935
§ 371 (c)(1),
(2) Date: Jan. 8, 2016

(87) PCT Pub. No.: WO2015/004957
PCT Pub. Date: Jan. 15, 2015

(65) Prior Publication Data

US 2016/0144656 A1 May 26, 2016

(30) Foreign Application Priority Data

Jul. 12, 2013 (JP) ..... 2013-146585

(51) Int. Cl.
*B44C 1/18* (2006.01)
*B44C 3/04* (2006.01)
(Continued)

(52) U.S. Cl.
CPC ..... *B44C 1/18* (2013.01); *B30B 5/02* (2013.01); *B44C 1/10* (2013.01); *B44C 3/048* (2013.01); *B44C 1/17* (2013.01)

(58) Field of Classification Search
CPC ..... B44C 1/18; B44C 1/1741; B44C 1/1708; B44C 1/172; B44C 1/1754; B44C 1/1712;
(Continued)

(56) References Cited

U.S. PATENT DOCUMENTS 4,863,667 A 9/1989 Martelli
5,427,518 A * 6/1995 Morizot ..... B29C 31/085 100/211
5,731,064 A 3/1998 Suss

FOREIGN PATENT DOCUMENTS

JP 02-137991 5/1990
JP 06-0480096 2/1994
(Continued)

OTHER PUBLICATIONS

Abstract for JP 2001-113642 2001.*
(Continued)

*Primary Examiner* — John Goff
(74) *Attorney, Agent, or Firm* — Rankin, Hill & Clark LLP

(57) ABSTRACT

A method for affixing a decorative object on an object that is to be decorated includes a process for causing the force holding the decorative object on an affixing film to differ locally; a process for attaching the decorative object on the surface of the affixing film on the side facing the object that is to be decorated; a process for disposing the affixing film to face the object that is to be decorated; and a process for, after air inside a cover and a vessel has been evacuated, introducing a fluid into the space between the affixing film and the cover, and applying pressure to affix the decorative object on the object that is to be decorated.

4 Claims, 14 Drawing Sheets

(51) Int. Cl.

| | |
|---|---|
| ***B30B 5/02*** | (2006.01) |
| ***B44C 1/10*** | (2006.01) |
| *B44C 1/17* | (2006.01) |

(58) Field of Classification Search

CPC ..... B44C 1/1733; B44C 1/17; B32B 37/025; B32B 37/1009; B32B 37/1018; B32B 2037/1063; B32B 2037/1081; B32B 38/008; B32B 38/0008; B29C 66/3432; B29C 66/344; B29C 65/76; B29C 65/785; B29C 65/7852; B29C 65/7855; B29C 66/028; B29C 66/00145; B30B 5/02

USPC ..... 156/230, 241, 247, 249, 583.3, 285, 286

See application file for complete search history.

(56) References Cited

FOREIGN PATENT DOCUMENTS

| | | |
|---|---|---|
| JP | 10-508260 | 8/1998 |
| JP | 2001-113642 | 4/2001 |
| JP | 2011-121200 | 6/2011 |
| JP | 2012-091329 A | 5/2012 |
| WO | 2011/071091 A1 | 6/2011 |

OTHER PUBLICATIONS

European Search Report dated May 9, 2017, 9 pages.
International Search Report, dated Jun. 17, 2014 (Jun. 17, 2014).
Japanese Office Action dated Jul. 26, 2016 with pertinent English portion included, 5 pages.

* cited by examiner

METHOD FOR AFFIXING DECORATIVE OBJECT AND DECORATIVE OBJECT

TECHNICAL FIELD

The present invention relates to a decorative object and a method of affixing a decorative object, in which the decorative object is affixed to an object that is to be decorated.

BACKGROUND ART

In Japanese Laid-Open Patent Publication No. 2011-121200, a method is disclosed for affixing a decorative sheet, which is a decorative object attached to an affixing film, to an object that is to be decorated, using a difference in pressure.

SUMMARY OF INVENTION

However, in the event that the affixing surface of the object to be decorated has a complex three-dimensional shape in portions thereof, then in relation to such portions, wrinkles tend to enter into the decorative sheet, and there is a need to extend or stretch the decorative sheet. However, cases are known to occur in which excessive stretching results in excess of the affixing range, and patterns, characters, symbols, etc., that are drawn on the decorative sheet become distorted.

Thus, the present invention has the object of providing a decorative object and a method of affixing a decorative object, which enhances the accuracy or reliability with which a decorative sheet can be affixed, by controlling an amount of stretching of the decorative sheet.

The present invention is characterized by a method of affixing a decorative object in which the decorative object is configured to be affixed to an object to be decorated, comprising a holding force adjusting step of causing a holding force of the decorative object with respect to an affixing film to differ locally, a step of attaching the decorative object to a surface on a side of the affixing film that faces toward the object to be decorated, a step of placing the affixing film in facing relation to the object to be decorated, and a step of, after air inside a cover member and a vessel has been reduced in pressure, introducing a fluid into a space between the affixing film and the cover member, to thereby pressure bond and affix the decorative object on the object to be decorated.

The present invention further is characterized by method of affixing a decorative object in which the decorative object is configured to be affixed to an object to be decorated, comprising a holding force adjusting step of causing a holding force of the decorative object with respect to an affixing film to differ locally, a step of attaching the decorative object to a surface on a side of the affixing film that faces toward the object to be decorated, a step of placing the affixing film in covering relation to the object to be decorated, and a step of reducing pressure of a space between the affixing film and the object to be decorated, to thereby pressure bond and affix the decorative object on the object to be decorated.

According to the present invention, in the method of affixing the decorative object, in the holding force adjusting step, the holding force of the decorative object with respect to the affixing film is made to differ locally, by locally changing a contact area between the affixing film and the decorative object.

According to the present invention, in the method of affixing the decorative object, in the holding force adjusting step, the holding force of the decorative object with respect to the affixing film is made to differ locally, by locally changing a charge amount between the affixing film and the decorative object.

According to the present invention, in the method of affixing the decorative object, in the holding force adjusting step, the holding force of the decorative object with respect to the affixing film is made to differ locally, by locally changing a magnetic force between the affixing film and the decorative object.

The present invention is further characterized by a decorative object to be affixed to an object to be decorated using an affixing film, wherein on the decorative object, a holding force of the decorative object with respect to the affixing film to which the decorative object is attached is configured to differ locally.

According to the present invention, in the decorative object, the holding force of the decorative object with respect to the affixing film is configured to differ locally, by a surface roughness of a surface of the decorative object that is attached to the affixing film being changed locally.

According to the present invention, in the decorative object, the holding force of the decorative object with respect to the affixing film is configured to differ locally, by a charge amount of the decorative object being changed locally.

According to the present invention, in the decorative object, the affixing film includes a magnet, and the holding force of the decorative object with respect to the affixing film is configured to differ locally, by an amount of magnetic bodies that are kneaded into the decorative object being changed locally.

According to the present invention, since the charge amount of the decorative object with respect to the affixing film is made to differ locally, the amount of stretching of the decorative object in relation to the amount of stretching of the affixing film can be controlled locally. As a result, when the decorative object is affixed to the object to be decorated, the possibility for wrinkles to occur in the decorative object can be controlled, while in addition, distortion of characters or patterns, etc., that are drawn on the decorative object can be prevented.

DESCRIPTION OF EMBODIMENTS

A preferred embodiment of a decorative object and a method of affixing a decorative object according to the present invention will be described below with reference to the accompanying drawings.

First Embodiment

Figure 1:
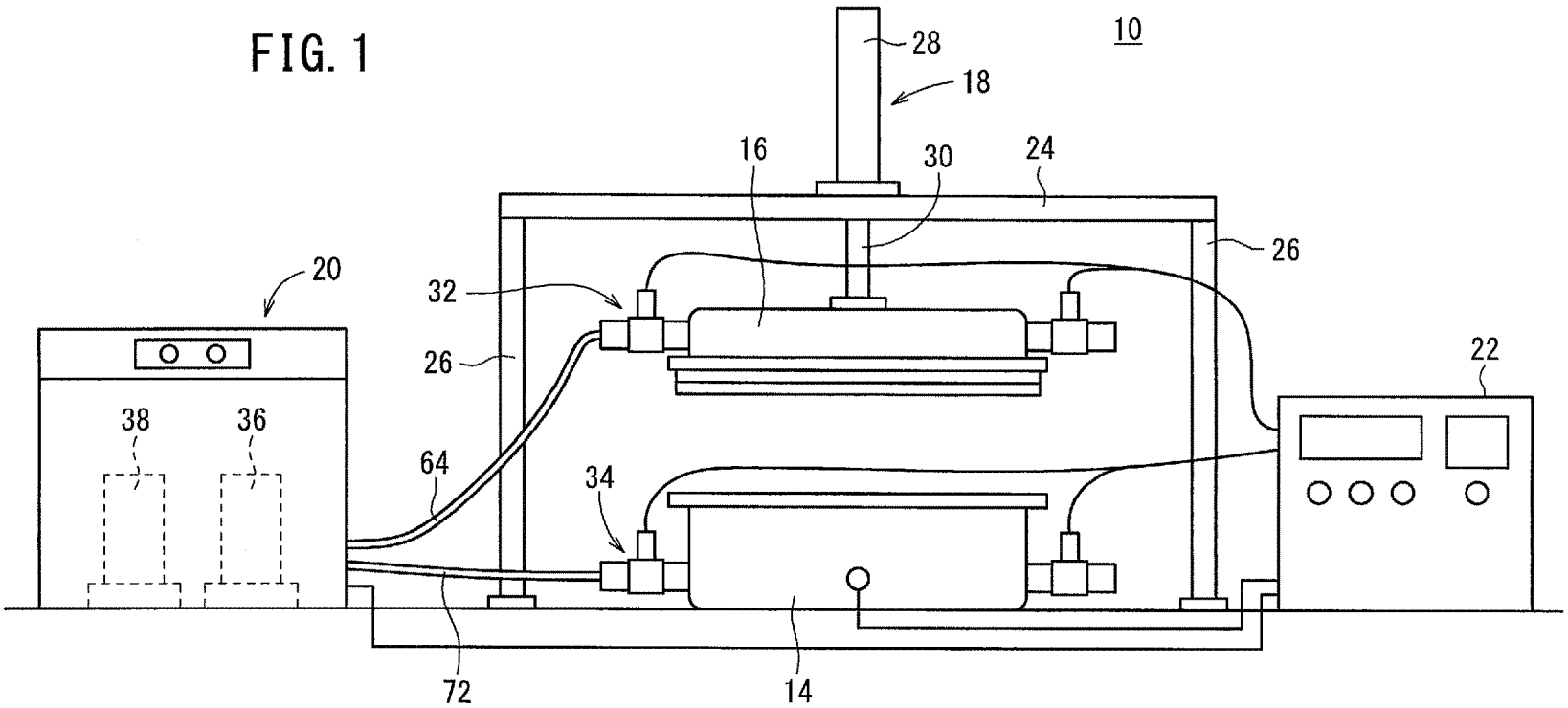
FIG. 1 is a structural diagram of an affixing apparatus according to a first embodiment.

FIG. 1 is a structural diagram of an affixing apparatus 10. The affixing apparatus 10 includes a vessel 14 that accommodates an object to be decorated 12 (see FIG. 2) and which opens upwardly, a cover member 16 that covers an opening of the vessel 14 from above, a raising and lowering mechanism 18 for raising and lowering the cover member 16, a pressure reducing mechanism 20 for reducing the pressure in the interior of the vessel 14 and the cover member 16, and a control unit 22 for controlling the raising and lowering mechanism 18 and the pressure reducing mechanism 20.

The raising and lowering mechanism 18 includes a frame 24, a plurality of support posts 26 that support the frame 24, and a cylinder 28 disposed on an upper surface side of the frame 24. A rod 30 of the cylinder 28 is connected to an upper surface of the cover member 16.

The pressure reducing mechanism 20 includes a cover member side evacuating mechanism 32 for evacuating a fluid (a fluid such as air or the like) on the side of the cover member 16, a vessel side evacuating mechanism 34 for evacuating a fluid (a fluid such as air or the like) on the side of the vessel 14, a cover member pressure reducing pump 36, and a vessel pressure reducing pump 38. The cover member side evacuating mechanism 32 is connected to the cover member pressure reducing pump 36, and the vessel side evacuating mechanism 34 is connected to the vessel pressure reducing pump 38.

Figure 2:
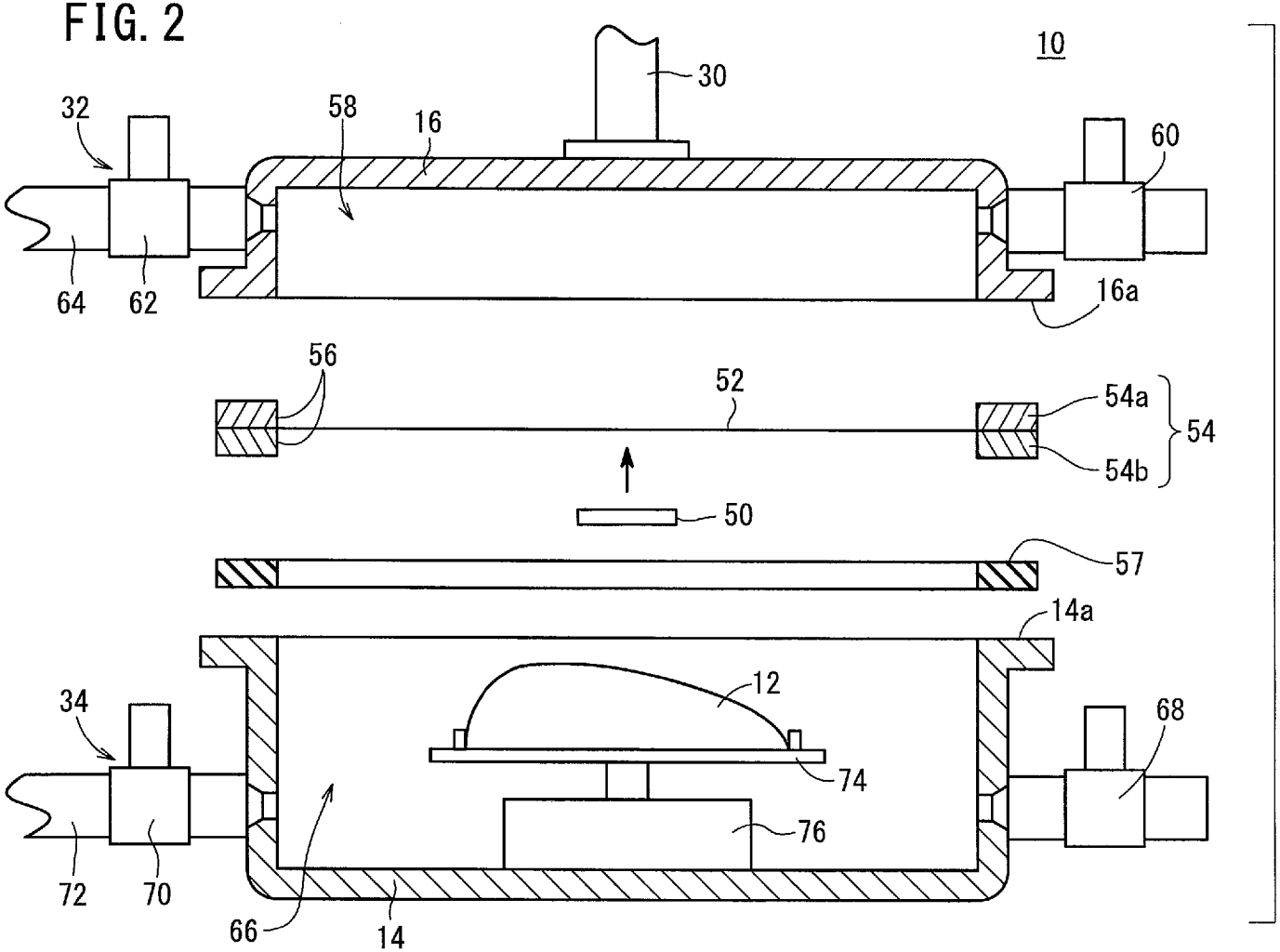
FIG. 2 is an enlarged cross-sectional view of an essential part of the affixing apparatus shown in FIG. 1.

FIG. 2 is an enlarged cross-sectional view of an essential part of the affixing apparatus 10. Between the cover member 16 and the vessel 14 that is disposed below the cover member 16, an affixing film 52 is disposed, with a decorative sheet 50 as a decorative object being attached on a lower surface of the affixing film 52. The affixing film 52 is retained by a film holding frame 54. The film holding frame 54 is a plate-shaped jig that supports an edge of the affixing film 52, and includes an opening 56 on an inner side thereof. The film holding frame 54 includes an upper holding frame 54*a* and a lower holding frame 54*b*, and retains the affixing film 52 by the upper holding frame 54*a* and the lower holding frame 54*b* sandwiching the affixing film 52 from above and below. It goes without saying that the openings 56 are disposed respectively in the upper holding frame 54*a* and the lower holding frame 54*b*. The film holding frame 54 is retained by a lower opening surface 16*a* of the cover member 16 and an upper opening surface 14*a* of the vessel 14. Reference numeral 57 indicates a frame-shaped packing that seals the film holding frame 54 and the upper opening surface 14*a* of the vessel 14.

On the cover member 16, there are provided the cover member side evacuating mechanism 32, which is a portion of the pressure reducing mechanism 20 that evacuates a fluid such as air or the like that exists in a space 58 formed by the affixing film 52 and the cover member 16, and a cover member side introduction valve 60 that introduces a fluid (a fluid such as air or the like) into the space 58. The cover member side evacuating mechanism 32 includes a cover member side evacuation valve 62, and a cover member side evacuating hose 64 that is connected to the cover member side evacuation valve 62 and guides the fluid to the cover member pressure reducing pump 36.

On the vessel 14, there are provided the vessel side evacuating mechanism 34, which is a portion of the pressure reducing mechanism 20 that evacuates a fluid such as air or the like that exists in a space 66 formed by the affixing film 52 and the vessel 14, and a vessel side introduction valve 68 that introduces a fluid (a fluid such as air or the like) into the space 66. The vessel side evacuating mechanism 34 includes a vessel side evacuation valve 70, and a vessel side evacuating hose 72 that is connected to the vessel side evacuation valve 70 and guides the fluid to the vessel pressure reducing pump 38.

It should be noted that the cover member side introduction valve 60 and the cover member side evacuation valve 62 may be replaced by a three-way valve that switches between introduction and evacuation of the fluid. Further, the vessel side introduction valve 68 and the vessel side evacuation valve 70 may be replaced by a three-way valve that switches between introduction and evacuation of the fluid.

In the vessel 14, there are provided a support base 74 that supports the object to be decorated 12, and a support base raising and lowering mechanism 76 that raises and lowers the support base 74. The vessel 14 may be of a size that is sufficient to enable the object to be decorated 12 to be accommodated therein.

Next, operations of the affixing apparatus 10 will be described using FIGS. 3A through 3C, and FIGS. 4A through 4C. The affixing apparatus 10 is operated in the order shown in FIGS. 3A through 3C, and FIGS. 4A through 4C.

Figure 3A:
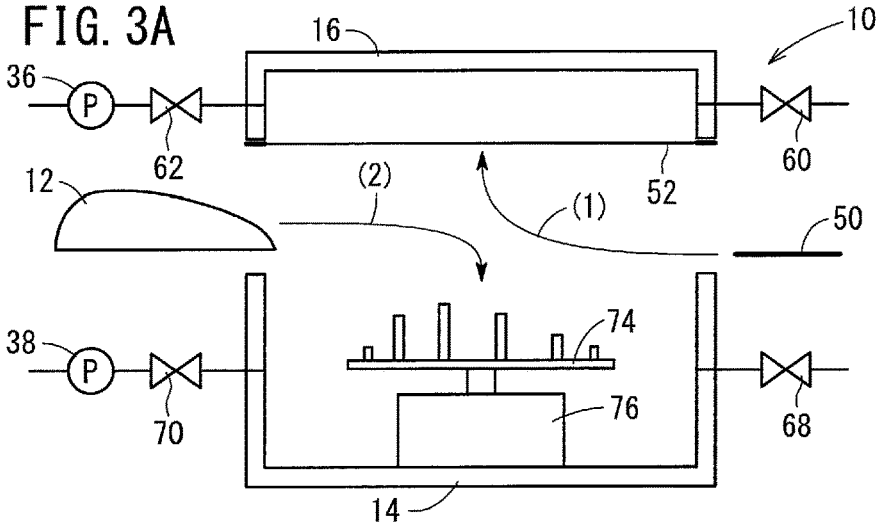
FIG. 3A is a diagram for describing a process of attaching a decorative sheet to a surface on a side of an affixing film that faces toward an object to be decorated or a support base.

FIG. 3A is a diagram for describing a process of attaching the decorative sheet 50 to a surface (lower surface) on a side of the affixing film 52 that faces toward the object to be decorated 12 or the support base 74. As shown by the arrow (1), the decorative sheet 50 is attached to the lower surface of the affixing film 52. At this time, as shown by the arrow (2), the object to be decorated 12 is set on the support base 74. Attachment of the decorative sheet 50, and setting of the object to be decorated 12 on the support base 74 may be carried out with either one of them being performed first, or they may be performed at the same time.

Before attaching the decorative sheet 50 to the affixing film 52, a holding force adjusting process is performed by which the holding force of the decorative sheet 50 with respect to the affixing film 52 is made to differ locally. The holding force adjusting process will be described in detail later.

Figure 3B:
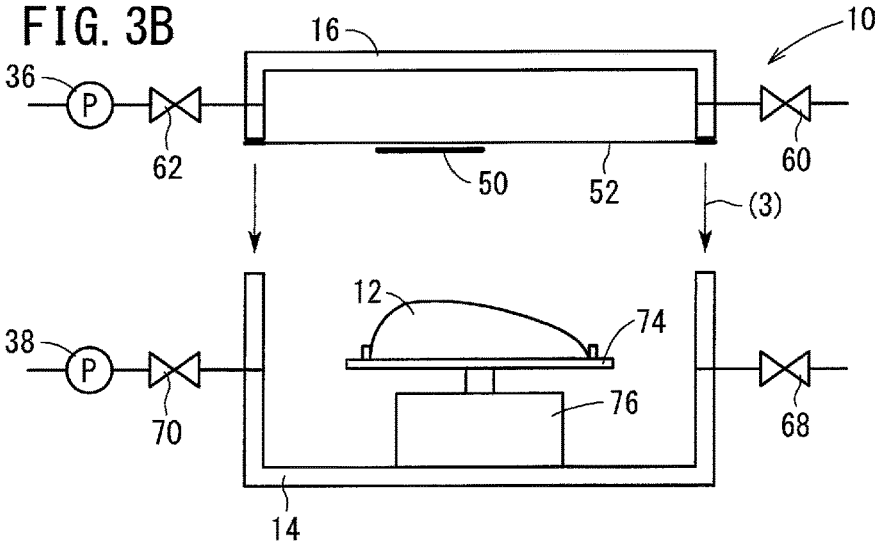
FIG. 3B is a diagram for describing a process of placing the affixing film in a facing position.

FIG. 3B is a diagram for describing a process of placing the affixing film 52 in a facing position. The control unit 22 controls the raising and lowering mechanism 18, whereby as shown by the arrow (3), the cover member 16 is lowered to cover the vessel 14, and the affixing film 52 is placed in facing relation with respect to the object to be decorated 12.

Figure 3C:
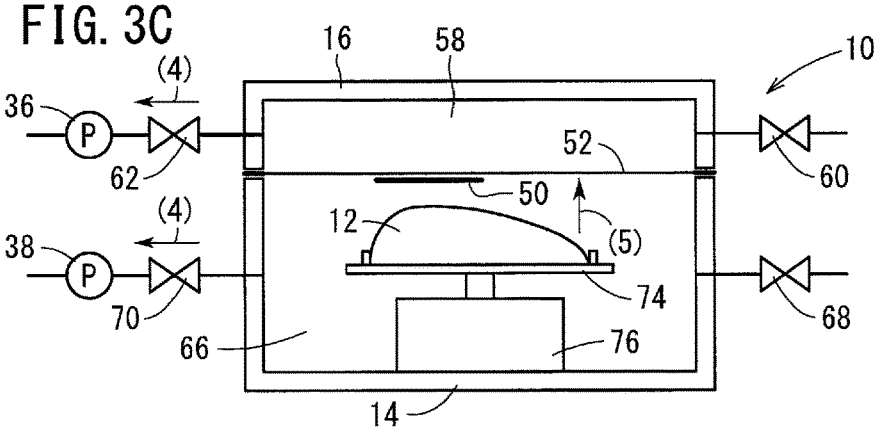
FIG. 3C is a diagram for describing a process of reducing pressure in spaces of a vessel and a cover member.

FIG. 3C is a diagram for describing a process of reducing pressure in the space 58 and the space 66. The control unit 22 opens the cover member side evacuation valve 62 and the vessel side evacuation valve 70, and activates the cover member pressure reducing pump 36 and the vessel pressure reducing pump 38, whereby as shown by the arrow (4), the fluid in the space 58 and the space 66 is evacuated, and the space 58 and the space 66 are reduced in pressure. At this time, since the pressures of both the space 58 and the space 66 are reduced together, no pressure difference is generated between the space 58 and the space 66. Moreover, at this time, by the control unit 22 controlling the support base raising and lowering mechanism 76, as shown by the arrow (5), the object to be decorated 12 may be raised and brought into contact with the decorative sheet 50. Consequently, positional shifting of the position at which the decorative sheet 50 is affixed with respect to the object to be decorated 12 can be prevented.

Figure 4A:
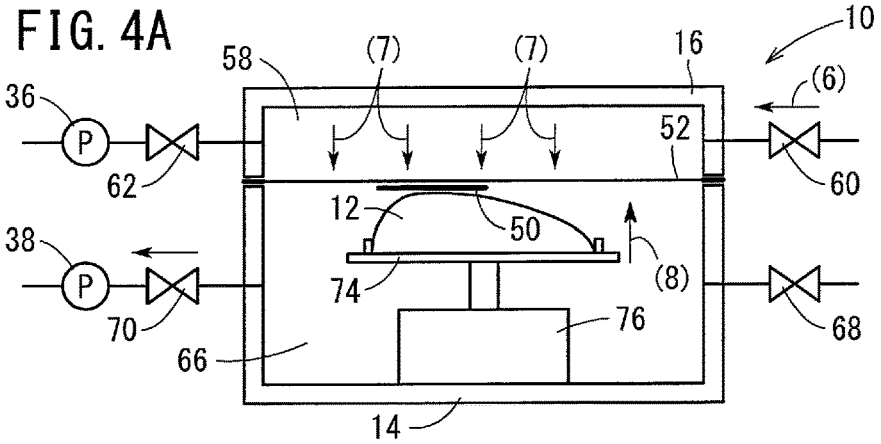
FIG. 4A is a diagram for describing a process of pressure bonding and affixing the decorative sheet to the object to be decorated.

FIG. 4A is a diagram for describing a process of pressure bonding and affixing the decorative sheet 50 to the object to be decorated 12. The control unit 22 stops the pressure reducing action of the space 58 by closing the cover member side evacuation valve 62, and opens the cover member side introduction valve 60, whereby as shown by the arrow (6), fluid is introduced into the space 58. Since the fluid is evacuated and the space 66 is reduced in pressure, a pressure difference is generated between the space 58 and the space 66. Due to such a pressure difference, as shown by the arrow (7), the affixing film 52 is pressed downwardly and stretched, and the decorative sheet 50 is pressure bonded along the shape of the object to be decorated 12, and is affixed to the object to be decorated 12. Moreover, at this time, by the control unit 22 controlling the support base raising and lowering mechanism 76, as shown by the arrow (8), the object to be decorated 12 may be raised. Consequently, it is possible to suppress deterioration by suppressing the amount of stretching of the affixing film 52.

Figure 4B:
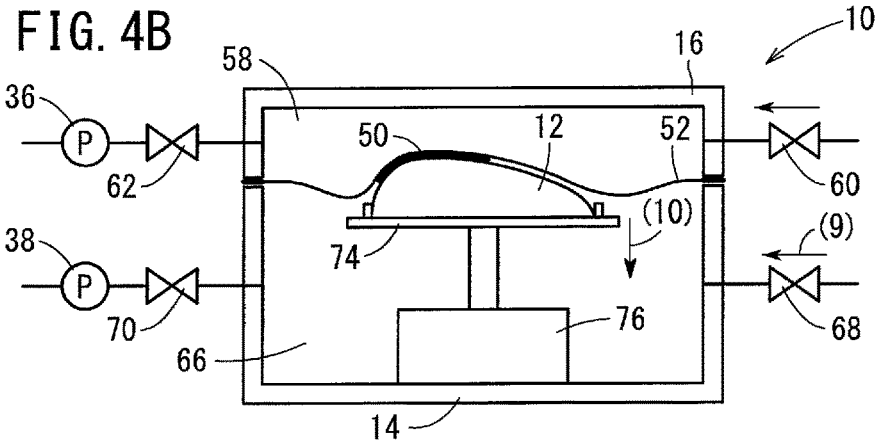
FIG. 4B is a diagram for describing a process of separating the affixing film from the object to be decorated.

FIG. 4B is a diagram for describing a process of separating the affixing film 52 from the object to be decorated 12. The control unit 22 stops the pressure reducing action of the space 66 by closing the vessel side evacuation valve 70, and opens the vessel side introduction valve 68, whereby as shown by the arrow (9), fluid is introduced into the space 66. Moreover, as shown in FIGS. 3C and 4A, in the case that the object to be decorated 12 has been raised, the control unit 22 controls the support base raising and lowering mechanism 76, whereby as shown by the arrow (10), the object to be decorated 12 is lowered, and the affixing film 52 is separated from the decorated object 12.

Figure 4C:
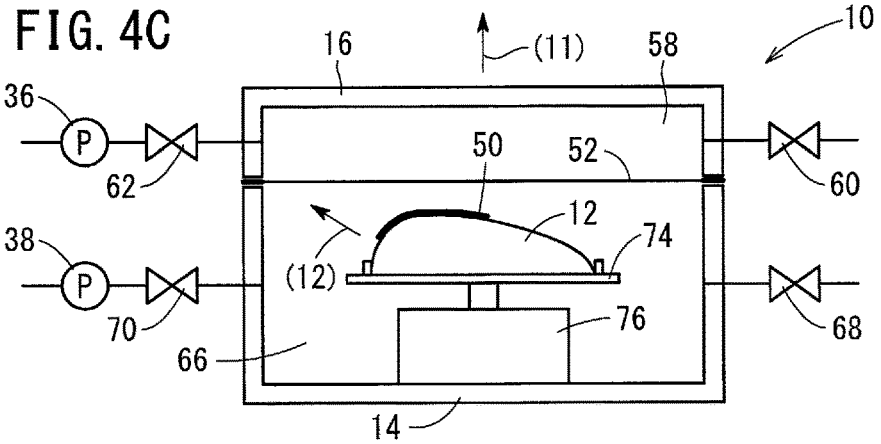
FIG. 4C is a diagram for describing a process of removing the decorated object from the affixing apparatus.

FIG. 4C is a diagram for describing a process of removing the decorated object 12 from the affixing apparatus 10. The control unit 22 controls the raising and lowering mechanism 18, whereby as shown by the arrow (11), the cover member 16 is raised. In addition, as shown by the arrow (12), the decorated object 12, to which the decorative sheet 50 has been affixed, is removed from the affixing apparatus 10.

Although the operations of the pressure reducing mechanism 20, the cover member side introduction valve 60, the cover member side evacuation valve 62, the vessel side introduction valve 68, and the vessel side evacuation valve 70 are carried out by controls of the control unit 22, such operations may also be performed manually.

Next, before describing the holding force adjusting process, the reason for performing the holding force adjusting process will be explained. The object to be decorated 12 includes a complex shape corresponding to the applied use thereof, and cases exist in which the affixing region of the object to be decorated 12, to which the decorative sheet 50 is affixed, does not have an entirely uniform surface shape.

Figure 5:
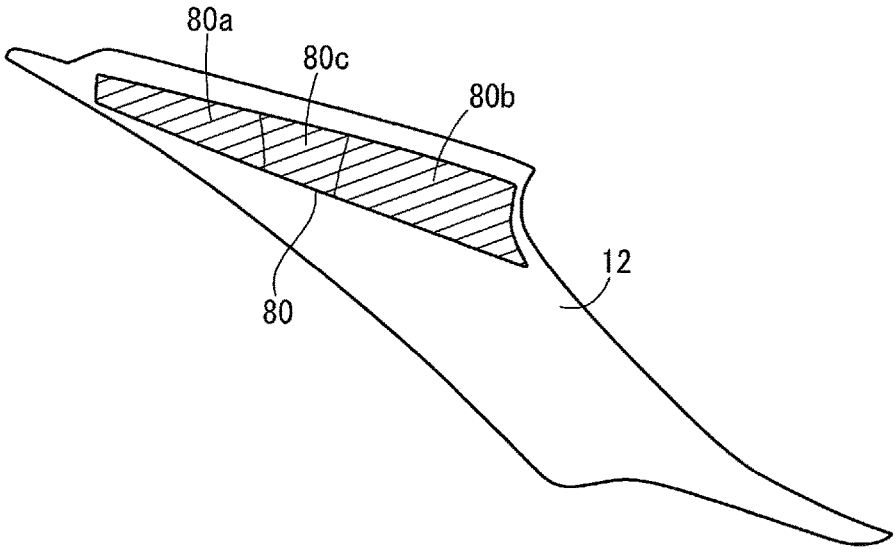
FIG. 5 is a view showing an example of the object to be decorated as shown in FIG. 2.

FIG. 5 is a view showing an example of the object to be decorated 12. As shown in FIG. 5, an affixing region 80 (the region indicated by hatching) of the object to be decorated 12 includes a region 80*a* of a substantially planar shape, a region 80*b* of a curved shape having a large curvature, and a region 80*c* disposed between the region 80*a* and the region 80*b*. The region 80*c* has a shape that changes smoothly from the substantially planar shape of the region 80*a* to the curved shape of the region 80*b*. Consequently, the shape of the region 80*c* is such that the shape thereof is of a nearly planar shape as it nears the region 80*a*, and is of a curved shape the curvature of which becomes gradually greater as it approaches the side of the region 80*b*.

Figure 6:
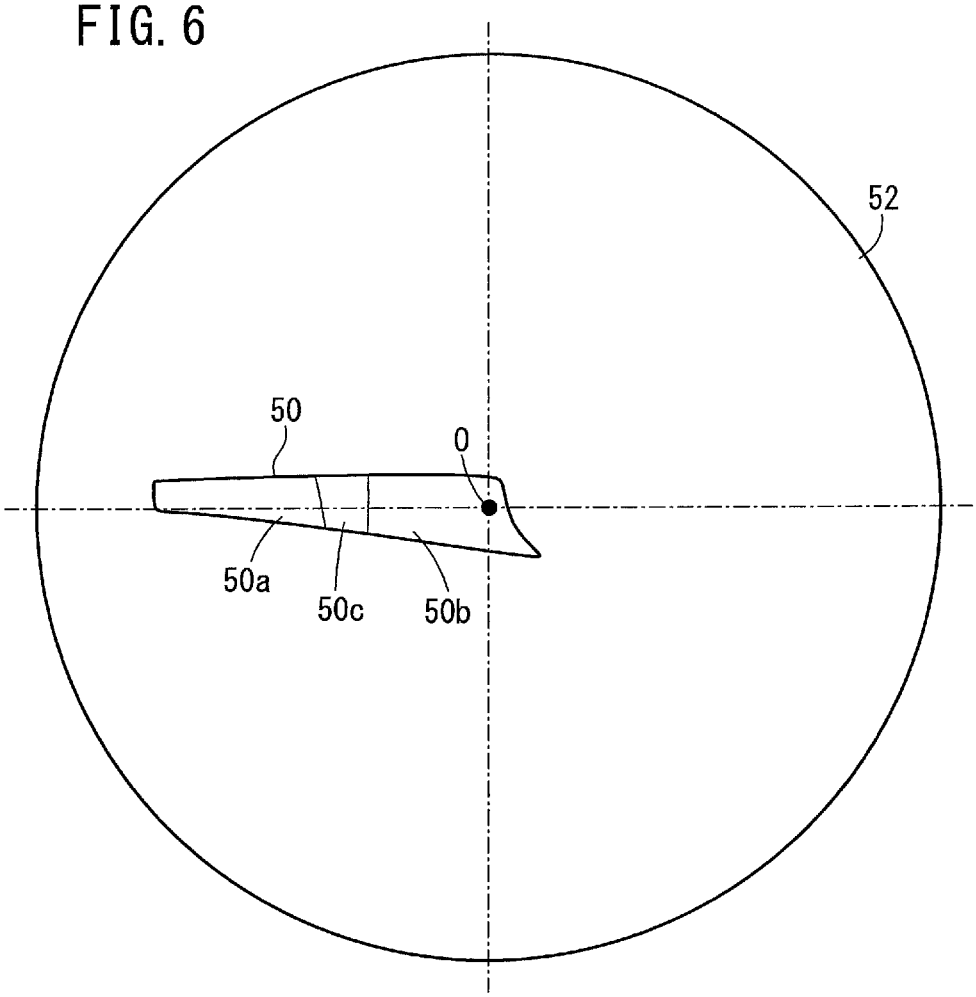
FIG. 6 is a view of the affixing film to which the decorative sheet is attached, as seen from a lower side of the affixing film.
Figure 7:
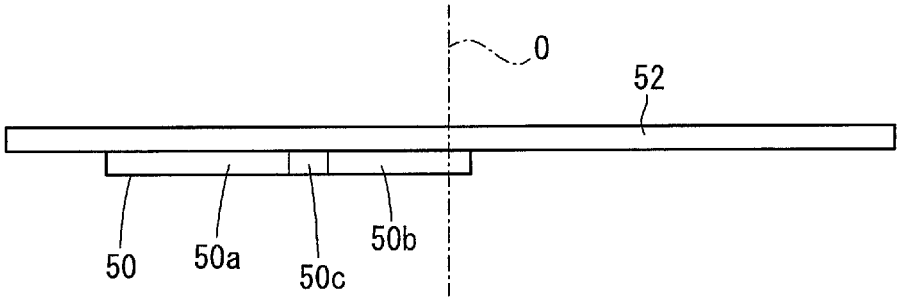
FIG. 7 is a cross-sectional view of the affixing film to which the decorative sheet is attached.

FIG. 6 is a view of the affixing film 52 to which the decorative sheet 50 is attached, as seen from a lower side of the affixing film 52, and FIG. 7 is a cross-sectional view of the affixing film 52 to which the decorative sheet 50 is attached. For facilitating description, in the decorative sheet 50 of FIGS. 6 and 7, the respective regions of the decorative sheet 50 that are affixed onto the regions 80*a*, 80*b*, 80*c* are indicated by regions 50*a*, 50*b*, 50*c*. Further, the point O indicates the center of the affixing film 52.

The region 50*a* of the decorative sheet 50 is affixed to the region 80*a* of the affixing region 80, and therefore, the region 50*a* preferably is affixed without being stretched relatively. As the reason therefor, if the region 50*a* of the decorative sheet 50 were attached so that it were stretched greatly on the planar shaped region 80*a*, then the decorative sheet 50 would be affixed while exceeding the range of the affixing region 80. Further, as a result, there is a possibility that patterns or the like drawn on the decorative sheet 50 would become distorted. Conversely, the region 50*b* of the decorative sheet 50 is affixed to the region 80*b* of the affixing region 80, and therefore, the region 50*b* preferably is affixed so that it is stretched greatly within the range of the affixing region 80. As the reason therefor, if the region 50*b* of the decorative sheet 50 were attached so that it were not stretched significantly on the region 80*b* of a curved shape, then wrinkles could occur in the decorative sheet 50.

Further, the region 50*c* of the decorative sheet 50 is affixed to the region 80*c* of the affixing region 80, and therefore, the decorative sheet 50 preferably is affixed so that it is stretched depending on the shape of the region 80*c*, within the range of the affixing region 80. In other words, within the region 80*c*, the region 50*c* of the decorative sheet 50 preferably is affixed while being stretched to a degree corresponding to the shape of the curved surface having a large curvature.

In this manner, assuming that the decorative sheet 50 can be affixed to the affixing region 80 of the object to be decorated 12, while the amount of stretching of the decorative sheet 50 is made to differ (made to change) locally, then the decorative sheet 50 can be affixed appropriately, and the accuracy or reliability with which the decorative sheet 50 is affixed is enhanced. In addition, the amount of stretching of the decorative sheet 50 is proportional to the holding force of the decorative sheet 50 with respect to the affixing film 52. The holding force is defined by the adhering force between the decorative sheet 50 and the affixing film 52, and the force by which the decorative sheet 50 and the affixing film 52 are attracted to each other.

As shown in FIG. 4B, since the affixing film 52 is placed in a stretched condition when the decorative sheet 50 is pressure bonded along the shape of the object to be decorated 12, in the case that the holding force between the decorative sheet 50 and the affixing film 52 is large (high), the decorative sheet 50 is stretched at an amount that is substantially the same as the amount of stretching of the affixing film 52. Conversely, in the case that the holding force between the decorative sheet 50 and the affixing film 52 is small, the decorative sheet 50 is only stretched by an amount that is smaller than the amount of stretching of the affixing film 52.

Consequently, by performing the holding force adjusting process, the holding force of the decorative sheet 50 with respect to the affixing film 52 is controlled to differ locally, whereby the amount of stretching of the decorative sheet 50 can be made to differ locally.

Below, the manner in which the holding force between the decorative sheet 50 and the affixing film 52 is controlled will be described.

Figure 8:
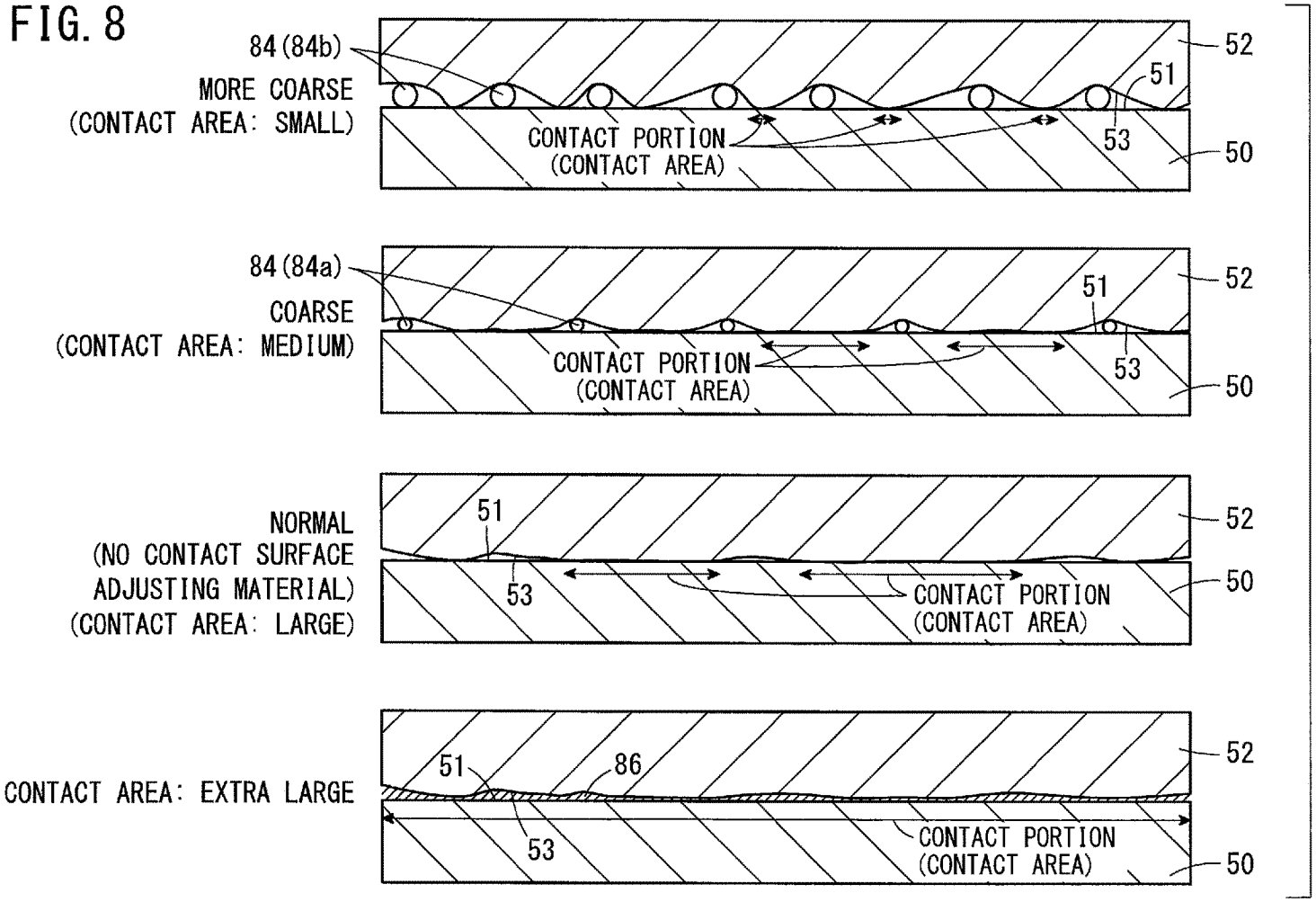
FIG. 8 is a view for explaining control of a holding force between a decorative sheet and an affixing film by a contact area between the decorative sheet and the affixing film, in which portions of the decorative sheet and the affixing film are shown at an enlarged scale.

FIG. 8 is a view for explaining control of a holding force between the decorative sheet 50 and the affixing film 52 by a contact area between the decorative sheet 50 and the affixing film 52, in which portions of the decorative sheet 50 and the affixing film 52 are shown at an enlarged scale. As the contact area between the affixing film 52 and the decorative sheet 50 becomes larger, the holding force by the intermolecular force increases, due to the fact that the distance between a contact surface 53 of the affixing film 52 and a contact surface 51 of the decorative sheet 50 is narrowed and the surfaces are placed in close contact. In addition, as the contact area between the affixing film 52 and the decorative sheet 50 becomes smaller, the distance between the contact surface 53 and the contact surface 51 becomes greater, and therefore, the holding force by the intermolecular force decreases.

Consequently, the contact areas between the affixing film 52 and the respective regions 50*a*, 50*b*, 50*c* of the decorative sheet 50 are made greater depending on ideal amounts by which the respective regions 50*a*, 50*b*, 50*c* are to be stretched. Owing thereto, the holding force of the decorative sheet 50 with respect to the affixing film 52 can be made to differ locally, and the amount of stretching of the respective regions 50*a*, 50*b*, 50*c* of the decorative sheet 50 can be controlled, respectively.

The contact area can be changed by the surface roughness of the contact surface 53 of the affixing film 52. More specifically, if the surface roughness of the surface (contact surface) 53 of the affixing film 52 on the side of the decorative sheet 50 is coarse, the contact area between the affixing film 52 and the decorative sheet 50 becomes small. On the other hand, if the surface roughness of the contact surface 53 of the affixing film 52 is fine (approximating a mirror surface), the contact area between the affixing film 52 and the decorative sheet 50 becomes large.

As shown in FIG. 8, the surface roughness can be changed by coating or pasting a powder 84, which serves as a type of contact area adjusting material, to the contact surface 51 of the decorative sheet 50. For example, by using a small particle powder 84 (84*a*), such as talc (mineral powder) or baby powder (Siccarol), etc., the surface roughness is made coarse, the distance between the contact surfaces 51, 53 increases, and the contact area can be reduced. Further, by using a large particle powder 84 (84*b*), the surface roughness is further coarsened, the distance between the contact surfaces 51, 53 further increases, and the contact area can be further reduced. Moreover, as shown in FIG. 8, by coating a gel-like material 86, which serves as a contact area adjusting member, the distance between the contact surfaces 51, 53 is narrowed, and the contact area can also be increased. In FIG. 8, the surface roughness of the surface (contact surface 51) of the decorative sheet 50 on the side of the affixing film 52 is constant, and is finely set.

Although an explanation has been made in FIG. 8 concerning changing the surface roughness of the contact surface 53 of the affixing film 52, the surface roughness of the contact surface 51 of the decorative sheet 50 may also be changed, or the surface roughness of both the contact surface 53 of the affixing film 52 and the surface roughness of the contact surface 51 of the decorative sheet 50 may also be changed.

Figure 9:
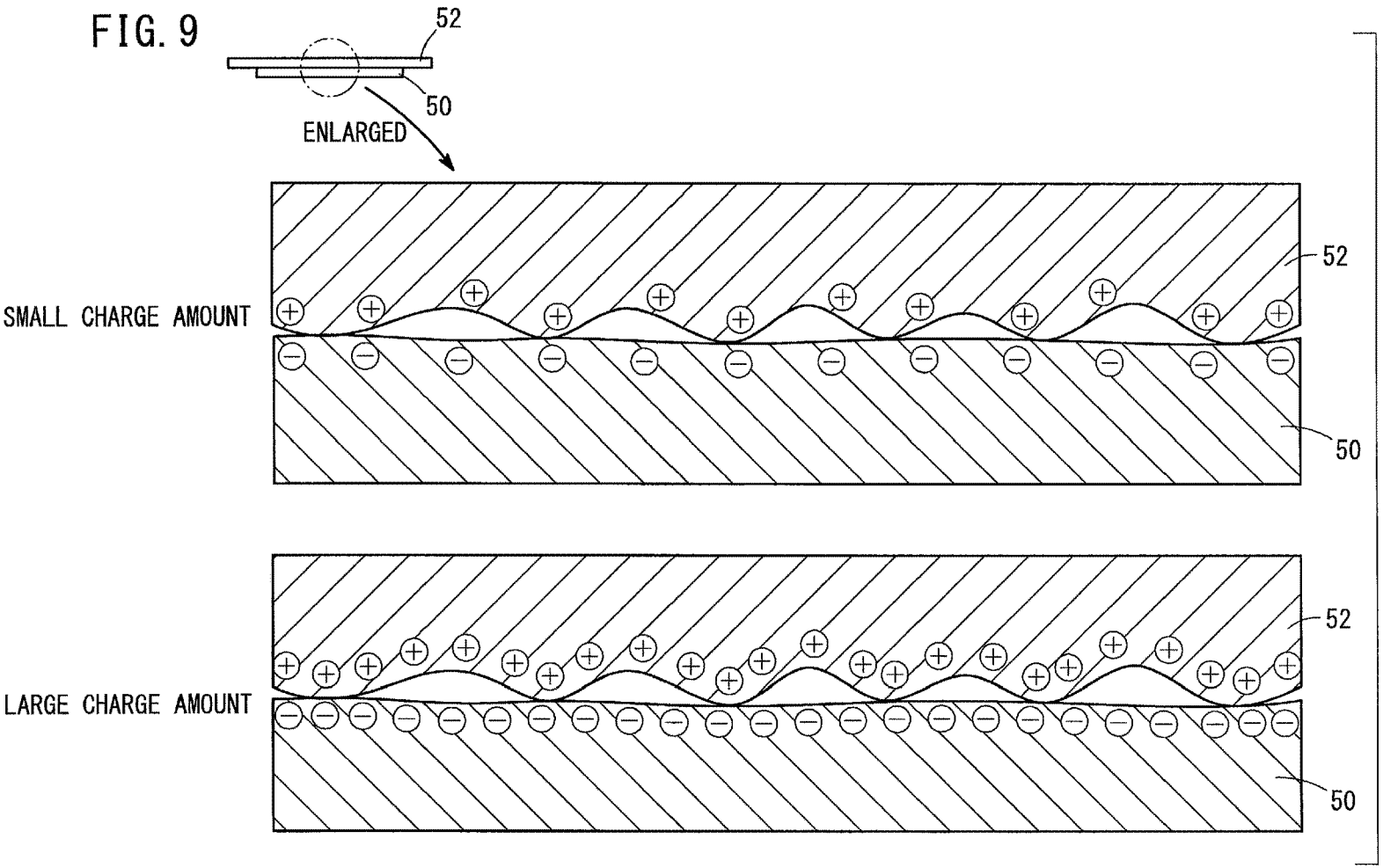
FIG. 9 is a view for explaining control of a holding force between a decorative sheet and an affixing film by static electricity, in which portions of the decorative sheet and the affixing film are shown at an enlarged scale.

FIG. 9 is a view for explaining control of a holding force between a decorative sheet 50 and the affixing film 52 by static electricity, in which portions of the decorative sheet 50 and the affixing film 52 are shown at an enlarged scale. As shown in FIG. 9, if the charge amount of the affixing film 52 and the decorative sheet 50 is small, the Coulomb force is weakened, and the holding force between the affixing film 52 and the decorative sheet 50 becomes small. On the other hand, if the charge amount of the affixing film 52 and the decorative sheet 50 is large, the Coulomb force is strengthened, and the holding force between the affixing film 52 and the decorative sheet 50 becomes large.

Consequently, the charge amounts of the respective regions 50*a*, 50*b*, 50*c* of the decorative sheet 50, and the charge amounts of the respective regions of the affixing film 52 to which the regions 50*a*, 50*b*, 50*c* of the decorative sheet 50 are attached are made greater depending on ideal amounts by which the regions 50*a*, 50*b*, 50*c* are to be stretched. Owing thereto, the holding force of the decorative sheet 50 with respect to the affixing film 52 can be made to differ locally, and the amount of stretching of the respective regions 50*a*, 50*b*, 50*c* of the decorative sheet 50 can be controlled, respectively.

The affixing film 52 is constituted from a material such a silicone or the like that is easy to be charged positively. The charge amount can be changed locally by locally reducing the positive charge amount of the affixing film 52 by ion neutralization using an ionizer device, and by locally increasing the charge amount using a charging device. Further, by bringing the decorative sheet 50 into contact with the positively charged affixing film 52, the decorative sheet 50 is charged with a negative charge in an amount corresponding to the positive charge amount by which the affixing film 52 has been charged. It should be noted that, although the affixing film 52 is charged with a positive charge, and the decorative sheet 50 is charged with a negative charge, the positive and negative charges thereof may be reversed.

Figure 10:
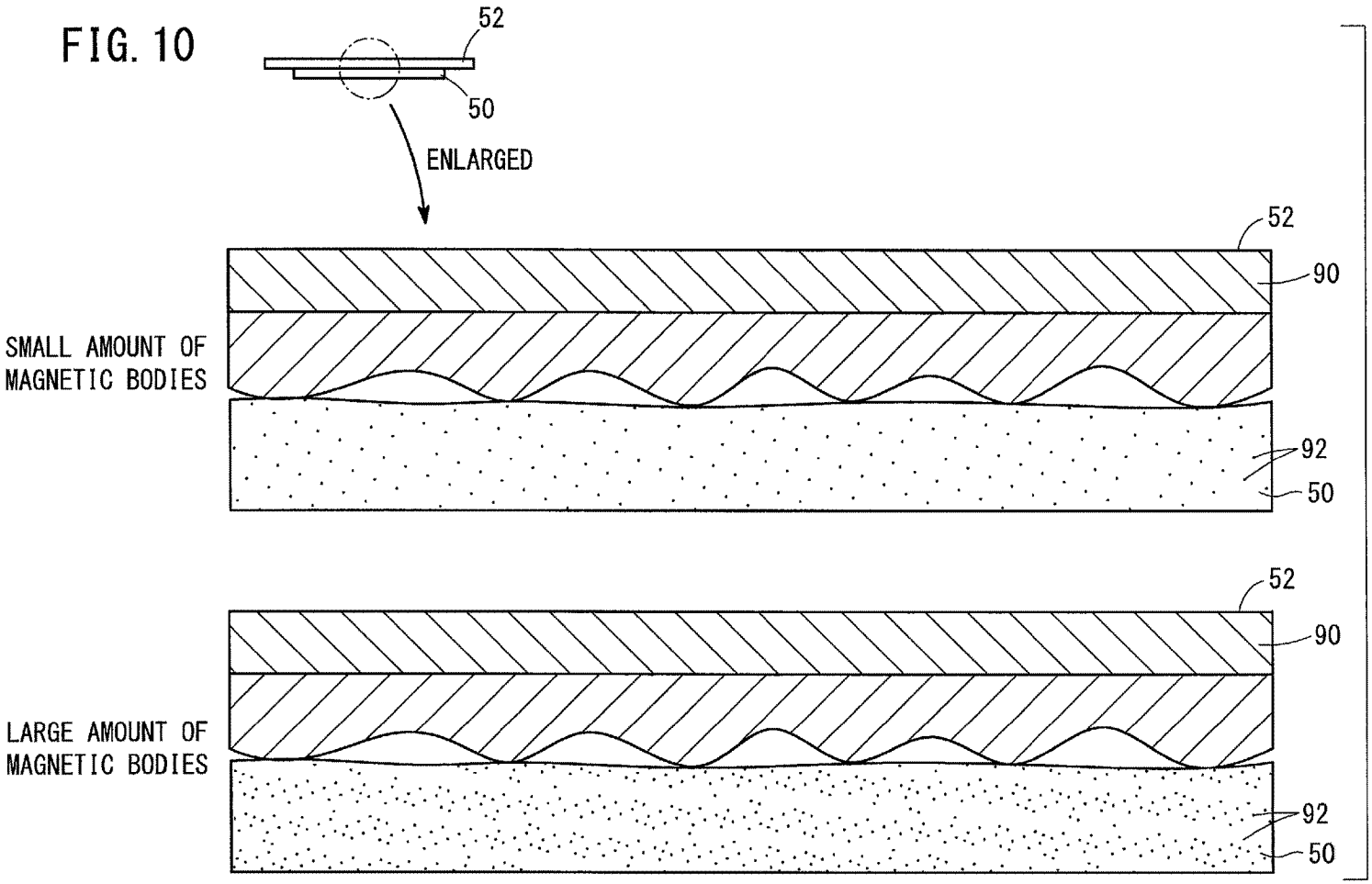
FIG. 10 is a view for explaining control of a holding force between a decorative sheet and an affixing film by a magnetic force, in which portions of the decorative sheet and the affixing film are shown at an enlarged scale.

FIG. 10 is a view for explaining control of a holding force between the decorative sheet 50 and the affixing film 52 by a magnetic force, in which portions of the decorative sheet 50 and the affixing film 52 are shown at an enlarged scale. As shown in FIG. 10, a magnet 90 is stacked on the affixing film 52, and magnetic bodies 92 of iron particles or the like are kneaded into the decorative sheet 50. If the amount of the magnetic bodies 92 that are kneaded into the decorative sheet 50 is small, the magnetic force thereof is weakened, and the holding force between the affixing film 52 and the decorative sheet 50 becomes small. On the other hand, if the amount of the magnetic bodies 92 that are kneaded into the decorative sheet 50 is large, the magnetic force thereof is strengthened, and the holding force between the affixing film 52 and the decorative sheet 50 becomes large.

Consequently, the amount of the magnetic bodies 92 that are kneaded into the respective regions 50*a*, 50*b*, 50*c* of the decorative sheet 50 is made greater depending on ideal amounts by which the respective regions 50*a*, 50*b*, 50*c* are to be stretched. Owing thereto, the holding force of the decorative sheet 50 with respect to the affixing film 52 can be made to differ locally, and the amount of stretching of the respective regions 50*a*, 50*b*, 50*c* of the decorative sheet 50 can be controlled, respectively.

Although the magnet 90 is shown as being stacked on the affixing film 52, a magnetic material may also be kneaded into the affixing film 52. Further, a magnet may be provided on the decorative sheet 50, and the magnetic bodies 92 may be kneaded into the affixing film 52. Further, instead of the magnet 90, a magnetism generating device that generates a magnetic force to attract the magnetic bodies 92 may be disposed on the side of the affixing film 52. In this case, the magnetic force generated by the magnetism generating device may be changed for each of respective regions of the affixing film 52.

Second Embodiment

Figure 11:
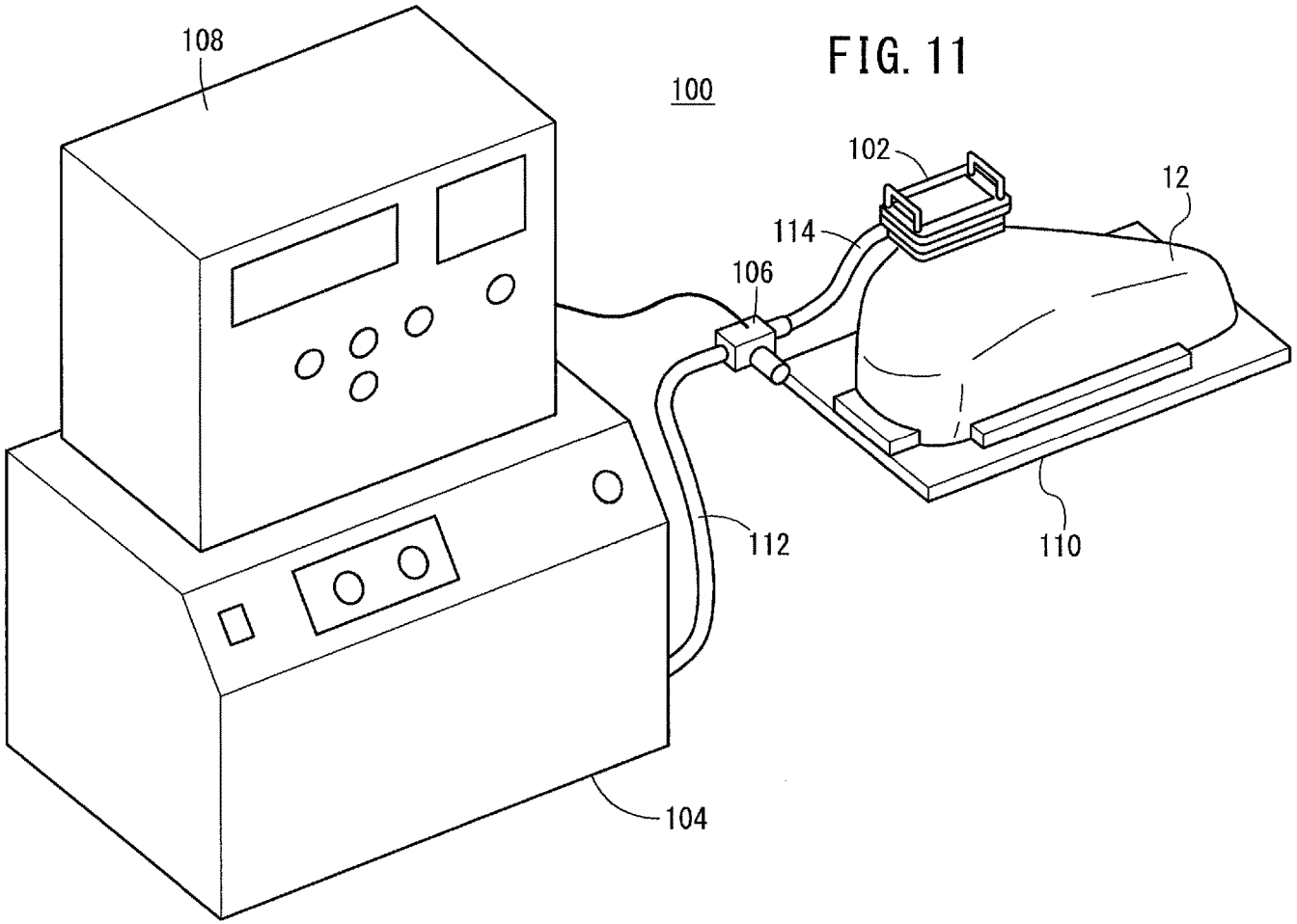
FIG. 11 is a structural diagram of an affixing apparatus according to a second embodiment.

FIG. 11 is a structural diagram of an affixing apparatus 100 according to a second embodiment. Constituent elements thereof which are the same as those in the aforementioned first embodiment are denoted by the same reference characters, and description of such features is omitted.

The affixing apparatus 100 is equipped with an affixing mechanism 102 that affixes the decorative sheet 50 to the object to be decorated 12, and which is held manually and is capable of being moved, a pressure reducing pump 104 that reduces the pressure of a space between the affixing mechanism 102 and the object to be decorated 12, an introduction and evacuation valve 106, which is a three-way valve, for carrying out introduction and evacuation of fluid in the space between the affixing mechanism 102 and the object to be decorated 12, a control unit 108 that controls the pressure reducing pump 104 and the introduction and evacuation valve 106, and a support base 110 that supports the object to be decorated 12. A first port of the introduction and evacuation valve 106 is connected through a hose 112 to the pressure reducing pump 104, a second port is connected through a hose 114 to the affixing mechanism 102, and a third port is open to atmosphere.

Figure 12:
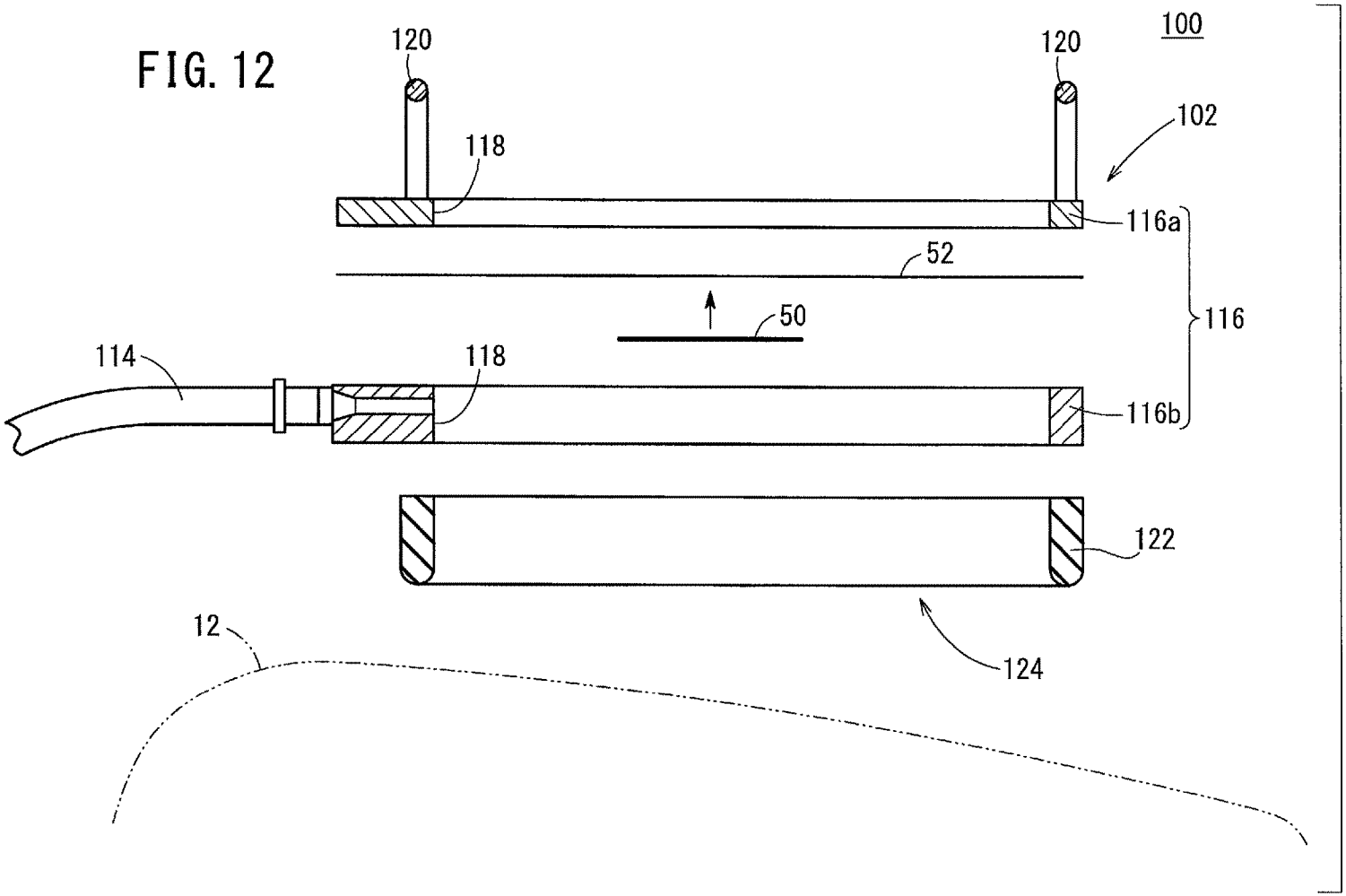
FIG. 12 is an enlarged cross-sectional view of an essential part of the affixing apparatus shown in FIG. 11.

FIG. 12 is an enlarged cross-sectional view of an essential part of the affixing apparatus 100. The affixing mechanism 102 comprises a film holding frame 116 for retaining the affixing film 52 to which the decorative sheet 50 is attached as a decorative object on a lower surface thereof. The film holding frame 116 is a plate-shaped jig that supports an edge of the affixing film 52, and includes an opening 118 on an inner side thereof. The film holding frame 116 includes an upper holding frame 116*a* and a lower holding frame 116*b*, and retains the affixing film 52 by the upper holding frame 116*a* and the lower holding frame 116*b* sandwiching the affixing film 52 from above and below. It goes without saying that the opening 118 is disposed respectively in the upper holding frame 116*a* and the lower holding frame 116*b*.

A handle 120 that can be grasped by hand is provided on the upper holding frame 116*a*. A frame-shaped packing 122 that seals the object to be decorated 12 and the lower holding frame 116*b* is disposed downwardly of the lower holding frame 116*b*. The introduction and evacuation valve 106, which performs introduction and evacuation of fluid in a space 124 between the object to be decorated 12 and the affixing film 52 that is formed in a state in which the packing 122 is pressed against the object to be decorated 12, and the lower holding frame 116*b* are connected through the hose 114.

Instead of a three-way valve, the introduction and evacuation valve 106 may be constituted by an evacuation valve that is used for evacuating the fluid, and an introduction valve that is used for introducing the fluid.

Next, operations of the affixing apparatus 100 according to the second embodiment will be described using FIGS. 13A through 13C, and FIGS. 14A through 14B. The affixing apparatus 100 is operated in the order shown in FIGS. 13A through 13C, and FIGS. 14A through 14B.

Figure 13A:
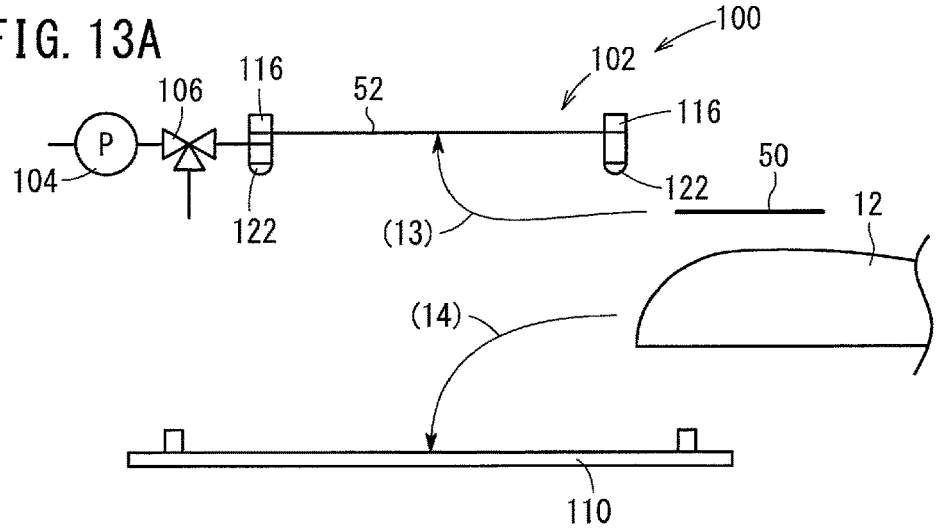
FIG. 13A is a diagram for describing a process of attaching a decorative sheet to a surface on a side of an affixing film that faces toward an object to be decorated.

FIG. 13A is a diagram for describing a process of attaching the decorative sheet 50 to a surface (lower surface) on a side of the affixing film 52 that faces toward the object to be decorated 12. As shown by the arrow (13), the decorative sheet 50 is attached to the lower surface of the affixing film 52. At this time, as shown by the arrow (14), the object to be decorated 12 is set on the support base 110. Attachment of the decorative sheet 50, and setting of the object to be decorated 12 on the support base 110 may be carried out with either one of them being performed first, or they may be performed at the same time.

Before attaching the decorative sheet 50 to the affixing film 52, as was described above in relation to the first embodiment, a holding force adjusting process is performed by which the holding force of the decorative sheet 50 with respect to the affixing film 52 is made to differ locally.

Figure 13B:
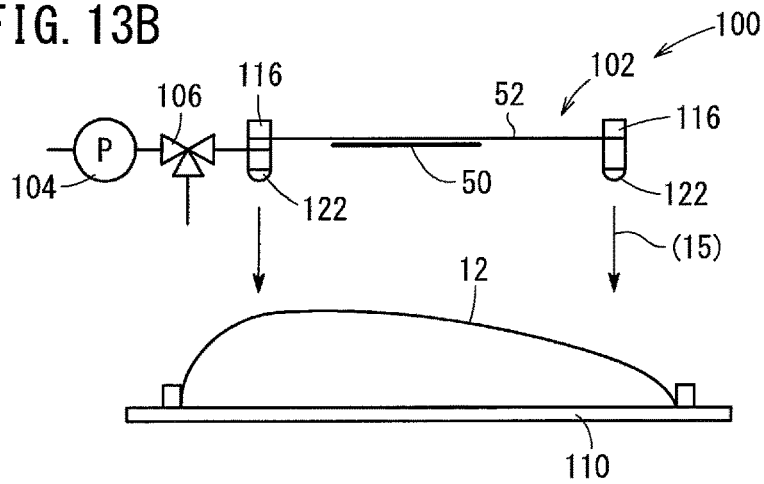
FIG. 13B is a diagram for describing a process of placing the affixing film in covering relation to the object to be decorated.

FIG. 13B is a diagram for describing a process of placing the affixing film 52 in covering relation to the object to be decorated 12. As shown by the arrow (15), the affixing mechanism 102 is lowered and arranged so as to cover the object to be decorated 12, whereupon the packing 122 is placed in intimate contact with the object to be decorated 12.

Figure 13C:
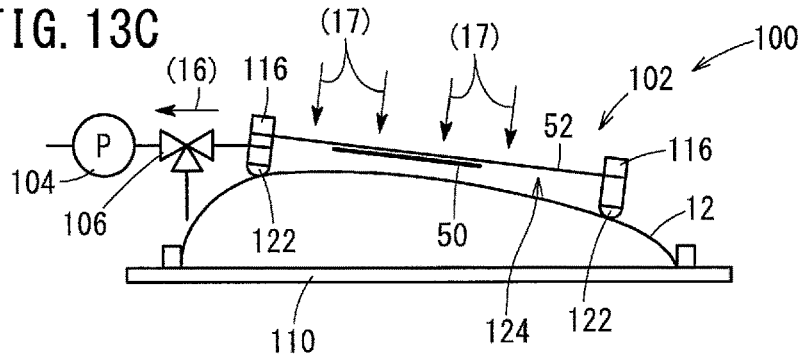
FIG. 13C is a diagram for describing a process of reducing pressure in a space between the affixing film and the object to be decorated, thereby pressure bonding and affixing the decorative sheet to the object to be decorated.

FIG. 13C is a diagram for describing a process of reducing pressure in the space 124 between the affixing film 52 and the object to be decorated 12, thereby pressure bonding and affixing the decorative sheet 50 to the object to be decorated 12. The control unit 108 opens communication between the first port and the second port of the introduction and evacuation valve 106, and activates the pressure reducing pump 104, whereby as shown by the arrow (16), fluid is evacuated from the space 124 between the affixing film 52 and the object to be decorated 12, and the space 124 is reduced in pressure.

At this time, since the pressure of the space 124 is reduced, a pressure difference occurs between the space 124 and the atmosphere. Due to such a pressure difference, as shown by the arrow (17), the affixing film 52 is pressed downwardly and stretched, and the decorative sheet 50 is pressure bonded along the shape of the object to be decorated 12, and is affixed to the object to be decorated 12.

Figure 14A:
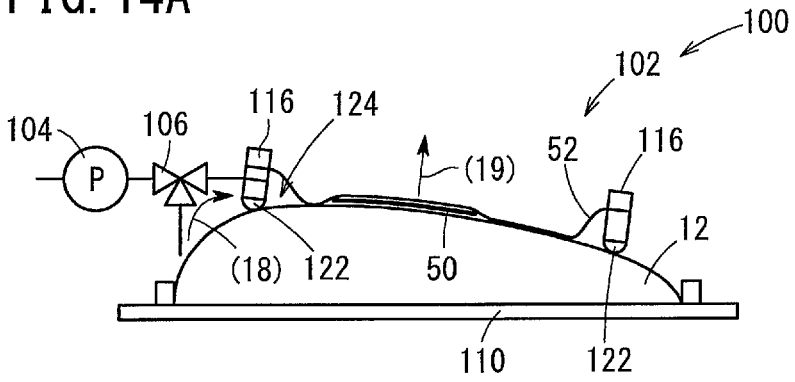
FIG. 14A is a diagram for describing a process of separating the affixing film from the object to be decorated.

FIG. 14A is a diagram for describing a process of separating the affixing film 52 from the object to be decorated 12. Communication between the second port and the third port of the introduction and evacuation valve 106 is opened, whereupon as shown by the arrow (18), fluid such as external air or the like is introduced into the space 124 between the affixing film 52 and the object to be decorated 12. In addition, as shown by the arrow (19), the affixing mechanism 102 is raised, and the affixing film 52 is separated from the decorated object 12.

Figure 14B:
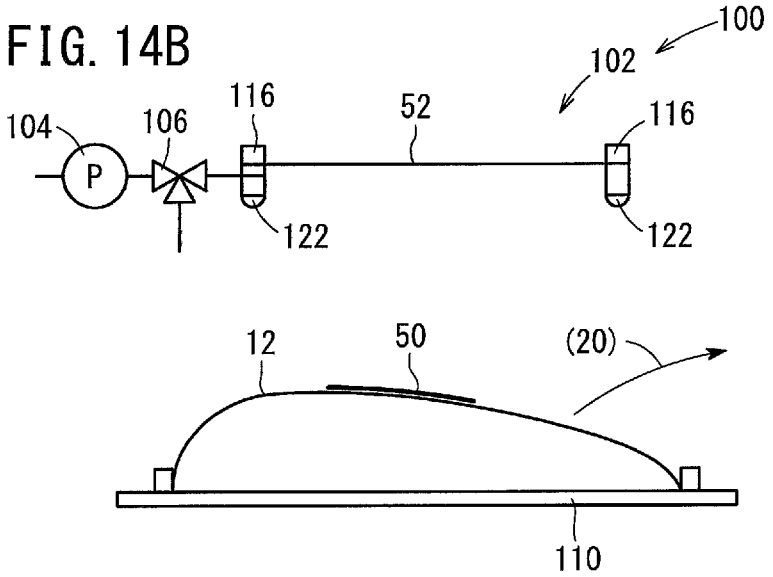
FIG. 14B is a diagram for describing a process of removing the decorated object from the affixing apparatus.

FIG. 14B is a diagram for describing a process of removing the decorated object 12 from the affixing apparatus 100. In a condition after the affixing mechanism 102 has been removed, as shown by the arrow (20), the decorated object 12, to which the decorative sheet 50 has been affixed, is removed from the affixing apparatus 100.

In this manner, according to the above-described first and second embodiments, since the holding force of the decorative sheet 50 with respect to the affixing film 52 is made to differ locally, the amount of stretching of the decorative sheet 50 in relation to the amount of stretching of the affixing film 52 can be controlled locally. As a result, when the decorative sheet 50 is affixed to the object to be decorated 12, the possibility for wrinkles to occur in the decorative sheet 50 can be controlled, while in addition, distortion of characters or patterns, etc., that are drawn on the decorative sheet 50 can be prevented.

The invention claimed is:

1. A method of affixing a decorative object in which the decorative object is configured to be affixed to an object to be decorated, comprising the steps of:

a holding force adjusting step of causing a holding force of the decorative object with respect to an affixing film to differ locally depending on a curvature of the object to be decorated, to which the decorative object is to be affixed;

a step of attaching the decorative object to a surface on a side of the affixing film that faces toward the object to be decorated;

a step of placing the affixing film in facing relation to the object to be decorated; and a step of, after air inside a cover member and a vessel has been reduced in pressure, introducing a fluid into a space between the affixing film and the cover member, to thereby pressure bond and affix the decorative object on the object to be decorated, wherein, in the holding force adjusting step, the holding force of the decorative object with respect to the affixing film is made to differ locally, by locally changing a charge amount between the affixing film and the decorative object.

2. A method of affixing a decorative object in which the decorative object is configured to be affixed to an object to be decorated, comprising the steps of:

a holding force adjusting step of causing a holding force of the decorative object with respect to an affixing film to differ locally depending on a curvature of the object to be decorated, to which the decorative object is to be affixed;

a step of attaching the decorative object to a surface on a side of the affixing film that faces toward the object to be decorated;

a step of placing the affixing film in covering relation to the object to be decorated; and a step of reducing pressure of a space between the affixing film and the object to be decorated, to thereby pressure bond and affix the decorative object on the object to be decorated, wherein, in the holding force adjusting step, the holding force of the decorative object with respect to the affixing film is made to differ locally, by locally changing a charge amount between the affixing film and the decorative object.

3. A method of affixing a decorative object in which the decorative object is configured to be affixed to an object to be decorated, comprising the steps of:

a holding force adjusting step of causing a holding force of the decorative object with respect to an affixing film to differ locally depending on a curvature of the object to be decorated, to which the decorative object is to be affixed;

a step of attaching the decorative object to a surface on a side of the affixing film that faces toward the object to be decorated;

a step of placing the affixing film in facing relation to the object to be decorated; and a step of, after air inside a cover member and a vessel has been reduced in pressure, introducing a fluid into a space between the affixing film and the cover member, to thereby pressure bond and affix the decorative object on the object to be decorated, wherein, in the holding force adjusting step, the holding force of the decorative object with respect to the affixing film is made to differ locally, by locally changing a magnetic force between the affixing film and the decorative object.

4. A method of affixing a decorative object in which the decorative object is configured to be affixed to an object to be decorated, comprising the steps of:

a holding force adjusting step of causing a holding force of the decorative object with respect to an affixing film to differ locally depending on a curvature of the object to be decorated, to which the decorative object is to be affixed;

a step of attaching the decorative object to a surface on a side of the affixing film that faces toward the object to be decorated;

a step of placing the affixing film in covering relation to the object to be decorated; and a step of reducing pressure of a space between the affixing film and the object to be decorated, to thereby pressure bond and affix the decorative object on the object to be decorated, wherein, in the holding force adjusting step, the holding force of the decorative object with respect to the affixing film is made to differ locally, by locally changing a magnetic force between the affixing film and the decorative object.

* * * * *